US012116714B2

(12) United States Patent
Lee et al.

(10) Patent No.: US 12,116,714 B2
(45) Date of Patent: Oct. 15, 2024

(54) LAUNDRY TREATING APPARATUS AND METHOD FOR CONTROLLING THE SAME

(71) Applicant: LG Electronics Inc., Seoul (KR)

(72) Inventors: Sunho Lee, Seoul (KR); Youngjong Kim, Seoul (KR); Dongcheol Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 513 days.

(21) Appl. No.: 17/400,831

(22) Filed: Aug. 12, 2021

(65) Prior Publication Data

US 2022/0049399 A1 Feb. 17, 2022

(30) Foreign Application Priority Data

Aug. 14, 2020 (KR) ..... 10-2020-0102608

(51) Int. Cl.

| | |
|---|---|
| ***D06F 33/48*** | (2020.01) |
| ***D06F 23/04*** | (2006.01) |
| ***D06F 33/38*** | (2020.01) |
| ***D06F 33/40*** | (2020.01) |
| ***D06F 34/16*** | (2020.01) |

(Continued)

(52) U.S. Cl.

CPC ..... *D06F 33/48* (2020.02); *D06F 23/04* (2013.01); *D06F 33/38* (2020.02); *D06F 33/40* (2020.02); *D06F 34/16* (2020.02); *D06F 2103/26* (2020.02); *D06F 2105/48* (2020.02); *D06F 2105/52* (2020.02)

(58) Field of Classification Search

None

See application file for complete search history.

(56) References Cited

U.S. PATENT DOCUMENTS 4,787,220 A 11/1988 Noh
5,042,276 A * 8/1991 Kamano ..... D06F 33/40 68/12.14

(Continued)

FOREIGN PATENT DOCUMENTS

| | | |
|---|---|---|
| JP | H05257509 | 10/1993 |
| KR | 100273402 | 9/2000 |
| WO | WO9623925 | 8/1996 |

OTHER PUBLICATIONS

PCT International Search Report and Written Opinion in International Appln No. PCT/KR2021/010579, dated Nov. 26, 2021, 10 pages.

*Primary Examiner* — Cristi J Tate-Sims

(74) *Attorney, Agent, or Firm* — Fish & Richardson P.C.

(57) ABSTRACT

A laundry treating apparatus includes a cabinet, a tub, a drum, a water supply, a drain, a rotator rotatably disposed on a bottom surface of the drum, and a controller that controls rotation of the rotator. The rotator includes a bottom portion positioned on the bottom surface, a pillar protruding from the bottom portion toward an open surface, and a blade including a plurality of blades disposed to be spaced apart from each other along a circumferential direction of the pillar. The blade extends from the bottom portion toward the open surface in an inclined direction with respect to a longitudinal direction of the pillar. The rotator performs a first rotation for generating an ascending water flow and a second rotation for generating a descending water flow. The controller controls the rotator to alternately repeat the first rotation and the second rotation.

20 Claims, 9 Drawing Sheets

(51) Int. Cl.

| | |
|---|---|
| *D06F 103/26* | (2020.01) |
| *D06F 105/48* | (2020.01) |
| *D06F 105/52* | (2020.01) |

(56) References Cited

U.S. PATENT DOCUMENTS

| | | | | |
|---|---|---|---|---|
| 5,325,677 | A | 7/1994 | Payne et al. | |
| 2012/0118023 | A1* | 5/2012 | Guerrero Lara | D06F 37/308 68/12.19 |
| 2016/0362826 | A1* | 12/2016 | Obregon | D06F 17/06 |

* cited by examiner

LAUNDRY TREATING APPARATUS AND METHOD FOR CONTROLLING THE SAME

CROSS-REFERENCE TO RELATED APPLICATIONS

This application claims the benefit of Korean Patent Application No. 10-2020-0102608, filed on Aug. 14, 2020, which is hereby incorporated by reference as if fully set forth herein.

TECHNICAL FIELD

The present disclosure relates to a laundry treating apparatus, and more particularly, to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Korean Patent No. 10-0186729 discloses a laundry treating apparatus including a rotator disposed inside a drum. The laundry treating apparatus improves a washing efficiency by rotating the rotator to form a water flow.

An efficient design is required for the rotator such that the water flow formed by the rotation may improve the washing efficiency. Furthermore, a design that may effectively reduce a load on a motor by effectively reducing a load on the rotation of the rotator is required.

Therefore, it is an important task in the art to design the rotator such that the rotator may rotate to effectively improve the washing efficiency and the load on the rotation of the rotator may be effectively reduced.

SUMMARY

Embodiments of the present disclosure are intended to provide a laundry treating apparatus including a rotator that forms a water flow that may effectively improve a washing efficiency.

In addition, embodiments of the present disclosure are intended to provide a laundry treating apparatus that is efficiently designed to effectively improve a space utilization and a washing efficiency.

In addition, embodiments of the present disclosure are intended to provide a laundry treating apparatus and a method for controlling the same that may solve eccentricity of laundry occurring as a rotator is disposed.

As an example for solving the above problems, an object of the present disclosure is to provide a laundry treating apparatus and a method for controlling the same that may solve eccentricity of laundry by forming an ascending water flow through a rotator including a blade.

In addition, an object of the present disclosure is to provide a laundry treating apparatus and a method for controlling the same that may properly resolve unbalance resulted from the eccentricity even when cloths having different moisture content are accommodated in the drum.

More specifically, according to one embodiment of the present disclosure, provided is a laundry treating apparatus including a cabinet, a tub for providing therein a space for water to be stored, a drum rotatably disposed inside the tub, wherein the drum includes an open surface for inserting and withdrawing laundry therethrough and a bottom surface located on an opposite side of the open surface, a water supply for supplying water into the tub, a drain for draining water stored in the tub to the outside of the cabinet, a rotator rotatably disposed on the bottom surface and inside the drum, and a controller that controls rotation of the rotator, wherein the rotator includes a bottom portion positioned on the bottom surface, a pillar protruding from the bottom portion toward the open surface, and a blade including a plurality of blades disposed to be spaced apart from each other along a circumferential direction of the pillar, wherein the blade extends from the bottom portion toward the open surface along a direction inclined with respect to a longitudinal direction of the pillar, wherein the rotation of the rotator includes a first rotation of forming an ascending water flow and a second rotation of forming a descending water flow, wherein the controller controls the rotator such that the first rotation and the second rotation are alternately repeated.

In addition, provided is a laundry treating apparatus in which a rotation angle of the bottom portion based on the first rotation is greater than a rotation angle of the bottom portion based on the second rotation.

In addition, provided is a laundry treating apparatus in which the rotator has the rotation angle of the bottom portion based on the first rotation equal to or greater than twice the rotation angle of the bottom portion based on the second rotation.

In addition, provided is a laundry treating apparatus in which dehydration of the laundry is performed after the controller controls the rotator such that the first rotation and the second rotation are alternately repeated.

In addition, provided is a laundry treating apparatus in which the controller determines a degree of unbalance in the drum before dehydration of the laundry is performed, and when the degree of unbalance in the drum is equal to or less than a preset standard, the dehydration of the laundry is performed.

In addition, provided is a laundry treating apparatus in which, when the degree of unbalance in the drum is equal to or greater than the preset standard, re-water supply is performed into the tub, a cloth untangling cycle of dispersing the laundry is performed, and the controller determines the degree of unbalance in the drum again.

In addition, provided is a laundry treating apparatus in which, when the degree of unbalance in the drum is equal to or greater than the preset standard, a rinsing cycle is performed, and the controller controls the rotator such that the first rotation and the second rotation are alternately performed before rinsing the laundry when wash water for rinsing the laundry flows into the tub.

In addition, provided is a method for controlling a laundry treating apparatus including a cabinet, a tub for providing therein a space for water to be stored, a drum rotatably disposed inside the tub, wherein the drum includes an open surface for inserting and withdrawing laundry therethrough and a bottom surface located on an opposite side of the open surface, a water supply for supplying water into the tub, a drain for draining water stored in the tub to the outside of the cabinet, a rotator rotatably disposed on the bottom surface and inside the drum, and a controller configured to control rotation of the rotator, wherein the rotator includes a bottom portion positioned on the bottom surface, a pillar protruding from the bottom portion toward the open surface, and a blade including a plurality of blades disposed to be spaced apart from each other along a circumferential direction of the pillar, wherein the blade extends from the bottom portion toward the open surface along a direction inclined with respect to a longitudinal direction of the pillar, the method including a washing cycle for washing the laundry accommodated in the drum, and a first laundry aligning operation for allowing the rotator to alternately perform a first rotation for forming an ascending water flow and a second rotation for forming a descending water flow after the washing cycle is terminated.

In addition, provided is a method for controlling a laundry treating apparatus further including a first dehydration operation for discharging wash water in the tub to the outside of the cabinet when the first laundry aligning operation is terminated, a rinsing cycle for removing foreign substances or detergent remaining in the laundry after the first dehydration operation, and a second dehydration operation for discharging the wash water in the tub to the outside of the cabinet after the rinsing cycle.

In addition, provided is a method for controlling a laundry treating apparatus in which the first laundry aligning operation is controlled such that a rotation angle of the first rotation is greater than a rotation angle of the second rotation.

In addition, provided is a method for controlling a laundry treating apparatus in which the first laundry aligning operation is controlled such that the rotation angle of the first rotation is equal to or greater than twice the rotation angle of the second rotation.

In addition, provided is a method for controlling a laundry treating apparatus in which the first laundry aligning operation is performed multiple times.

In addition, provided is a method for controlling a laundry treating apparatus in which a first unbalance determination operation for determining whether a degree of unbalance in the drum is equal to or less than a preset standard is performed before the first dehydration operation is performed.

In addition, provided is a method for controlling a laundry treating apparatus in which, when the degree of unbalance in the drum is equal to or less than the preset standard, the first dehydration operation and the rinsing cycle are performed.

In addition, provided is a method for controlling a laundry treating apparatus in which, when the degree of unbalance in the drum is equal to or greater than the preset standard, a rinsing water supply operation for flowing wash water for the rinsing cycle into the tub before starting the rinsing cycle is performed, and when the wash water for the rinsing cycle is flowed into the tub, a second laundry aligning operation for allowing the rotator to alternately perform the first rotation and the second rotation is performed.

In addition, provided is a method for controlling a laundry treating apparatus in which the second laundry aligning operation is performed multiple times.

In addition, provided is a method for controlling a laundry treating apparatus in which, when the degree of unbalance in the drum is equal to or greater than the preset standard, a second unbalance determination operation for re-determining the degree of unbalance in the drum is performed after a cloth untangling cycle where the water supply into the tub is started and the laundry accommodated in the drum is dispersed is controlled to be performed before the rinsing cycle starts.

In addition, provided is a method for controlling a laundry treating apparatus in which an rpm of the drum in the first dehydration operation is lower than an rpm of the drum in the second dehydration operation.

In addition, provided is a method for controlling a laundry treating apparatus in which a rotation time of the drum in the first dehydration operation is shorter than a rotation time of the drum in the second dehydration operation.

According to the laundry treating apparatus and the method for controlling the same, the rotator may be disposed to allow the effective washing.

In addition, as the rotator is disposed, it is possible to solve the unbalance caused by the eccentricity.

DETAILED DESCRIPTION

Hereinafter, a specific embodiment of the present disclosure will be described with reference to the drawings. A following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of the prior art related to the present disclosure may unnecessarily obscure the gist of the present disclosure, the detailed description thereof will be omitted. In addition, terms to be described later are terms defined in consideration of functions in the present disclosure, which may vary based on intentions of users and operators, customs, or the like. Therefore, a definition thereof should be made based on a content throughout this specification. The terminology used in the detailed description is for the purpose of describing embodiments of the present disclosure only, and should not be limiting. As used herein, the singular forms 'a' and 'an' are intended to include the plural forms as well, unless the context clearly indicates otherwise. It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

Figure 1:
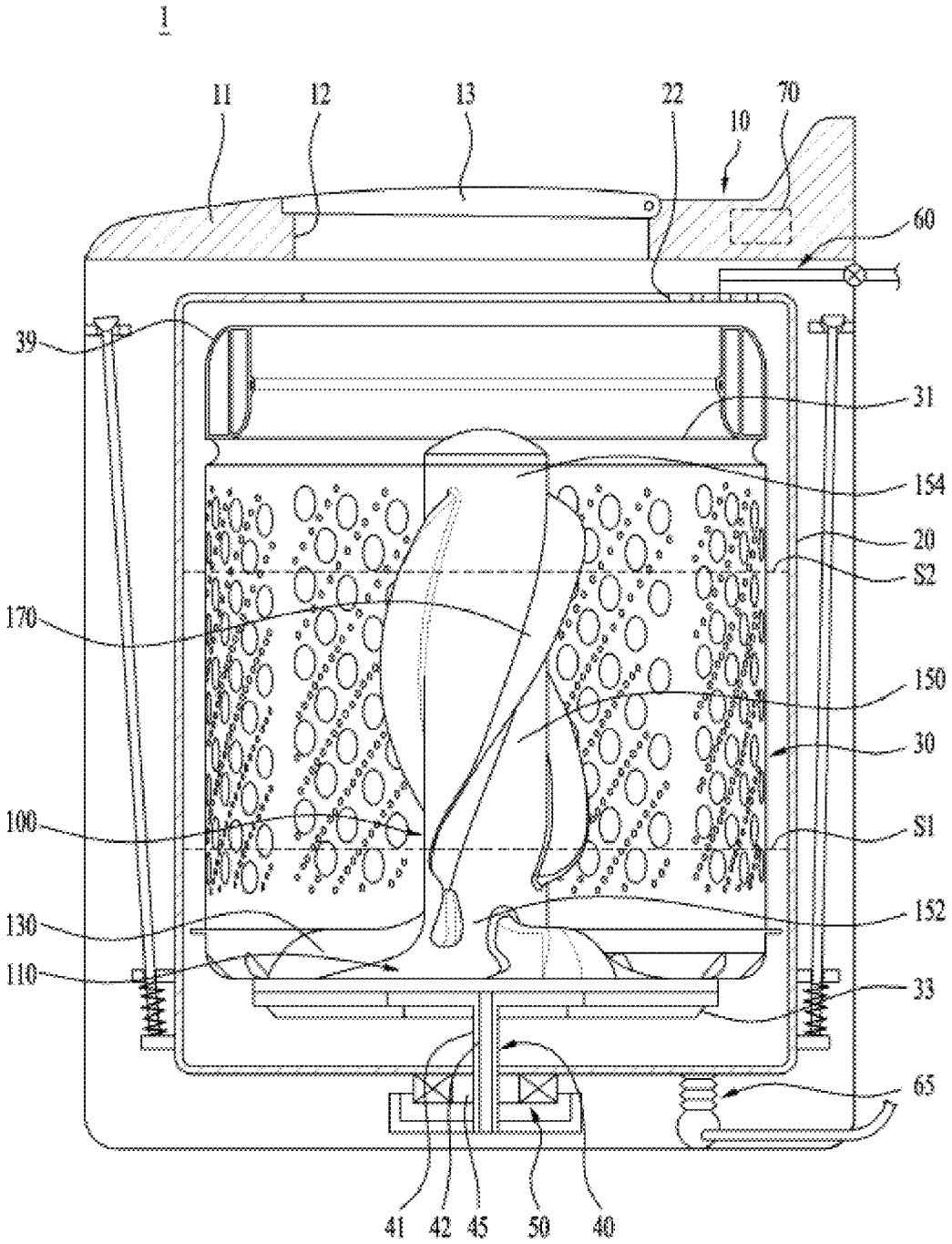
FIG. 1 is a view showing an interior of a laundry treating apparatus according to an embodiment of the present disclosure.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10, and a laundry door 13 for opening and closing the laundry inlet 12 is disposed on the top surface 11 according to an embodiment of the present disclosure. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a support of the tub 20. The support of the tub 20 may be in a structure capable of damping vibrations generated in the tub 20.

The tub 20 is supplied with water through a water supply 60. The water supply 60 may be composed of a water supply pipe that connects a water supply source with the tub 20, and a valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10, and a drain pump disposed on the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The drum 30 may have a drum opening defined therein positioned below the tub opening 22 to communicate with the inlet. One surface of the drum 30 may be opened to define an open surface 31 as will be described later, and the open surface 31 may correspond to the drum opening.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface 33 of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20. The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be constructed to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
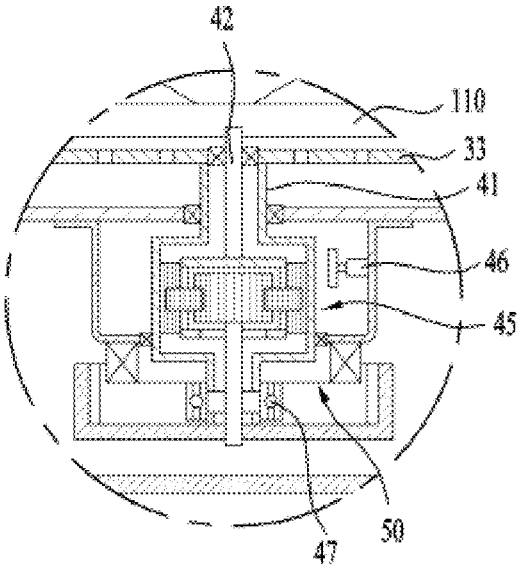
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a first rotation shaft 41 is coupled to the bottom surface 33 thereof, and the rotator 100 may be rotated by being coupled to a second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 41 connected to the ring gear.

The second clutch element 47 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 47.

In one embodiment of the present disclosure, when the first clutch element 46 and the second clutch element 47 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 41, and the second rotation shaft 42 are all in the stationary state. The controller 70 may implement a necessary driving state by appropriately controlling the driver 50, the first clutch element 46, the second clutch element 47, and the like in the washing process, the rinsing process, and the like.

Figure 3:
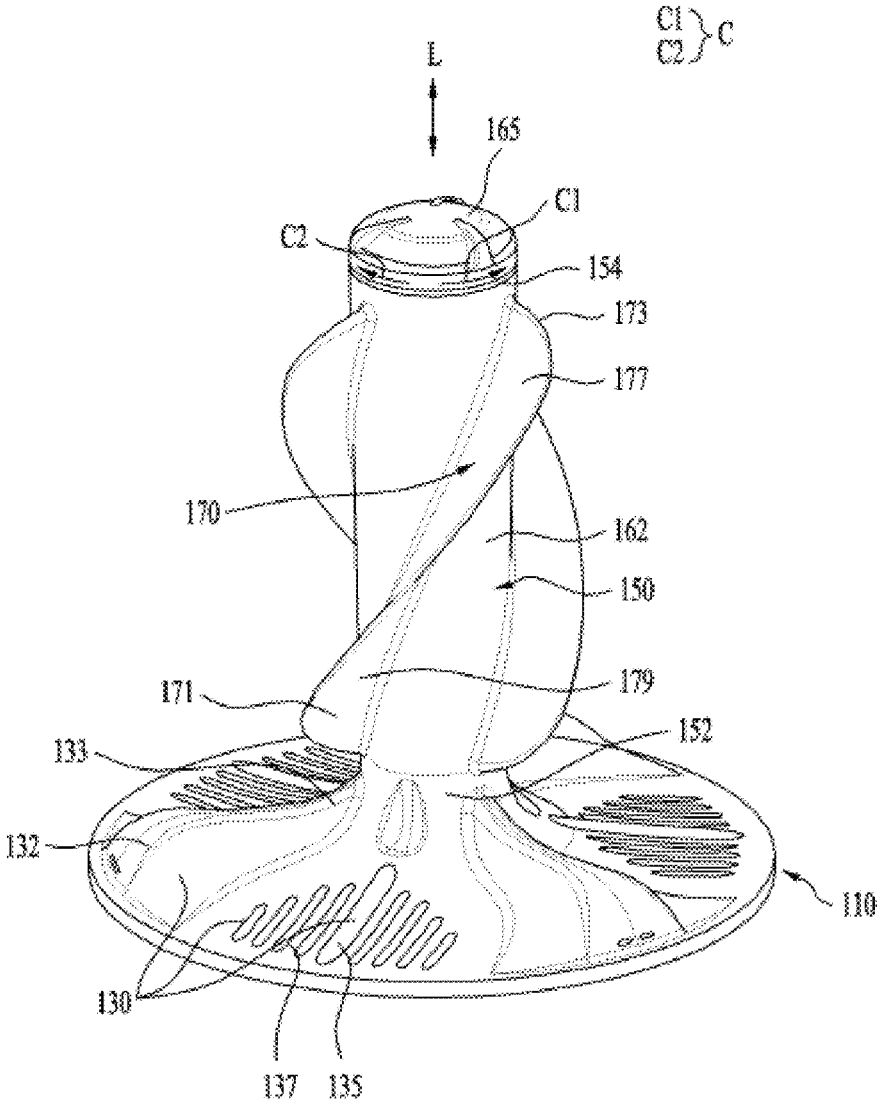
FIG. 3 is a perspective view illustrating a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface 33 of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height L1 from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances between the blades 170 may be the same. When viewed from the open surface 31 of the drum 30, the blades 170 may be spaced apart from each other at an angle of 120 degrees with respect to a center O of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length L3 of the blade 170 may be varied as needed.

As the blade 170 extends obliquely, when the rotator 100 is rotated, an ascending or descending water flow may be formed in the water inside the drum 30 by the blade 170 of the pillar 150.

For example, when the blade 170 extends from the bottom portion 110 toward the open surface 31 while being inclined with respect to one direction C1 among the circumferential directions C of the pillar 150, the descending water flow may be formed by the inclined shape of the blade 170 when the rotator 100 rotates in said one direction C1, and the ascending water flow may be formed by the blade 170 when the rotator 100 is rotated in the other direction C2.

In one embodiment of the present disclosure, said one direction C1 and the other direction C2 of the circumferential direction C of the pillar 150 may correspond to directions opposite to each other with respect to the outer circumferential surface 162 of the pillar 150, and may be a direction perpendicular to the longitudinal direction L of the pillar 150.

Said one direction C1 and the other direction C2 of the circumferential direction C of the pillar 150 may correspond to the rotation direction of the rotator 100. Because the rotation direction of the rotator 100 and the circumferential direction C of the pillar 150 are parallel to each other, the rotator 100 may be rotated in said one direction C1 or rotated in the other direction C2.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction C of the pillar 150, and may extend in the form of the screw from one end 171 facing the bottom portion 110 to the other end 173 facing the open surface 31.

In other words, in one embodiment of the present disclosure, the plurality of blades 170 may extend while being wound on the outer circumferential surface 162 from said one end 152 facing the bottom portion 110 to the other end 154 facing the open surface 31.

In one example, when referring to FIG. 3, in one embodiment of the present disclosure, the blade 170 may be inclined in said one direction C1 among the circumferential directions C of the pillar 150 with respect to the longitudinal direction L of the pillar 150, and may extend from said one end 171 to the other end 173.

That is, the blade 170 may be constructed to be inclined in only said one direction C1 and not to be inclined in the other direction C2. When the inclination direction of the blade 170 is changed to the other direction C2 during the extension, during the rotation of the rotator 100, a portion of the blade 170 may generate the ascending water flow and the remaining portion may generate the descending water flow.

In this case, the ascending water flow and the descending water flow may occur simultaneously in the rotation of the rotator 100 in said one direction C1, so that it may be difficult to maximize the effect of either ascending or descending of the water.

Accordingly, in one embodiment of the present disclosure, the blade 170 extends obliquely with respect to the longitudinal direction L of the pillar 150, and extends obliquely to said one direction C1 among the circumferential directions C of the pillar 150, so that water flow characteristics for the rotation of the rotator 100 in said one direction C1 and the other direction C2 may be maximized. Said one direction C1 may be one of a clockwise direction and a counterclockwise direction, and the other direction C2 may be the other one.

In one example, in one embodiment of the present disclosure as shown in FIG. 3, the blade 170 may continuously extend from said one end 171 to the other end 173. That is, the blade 170 may be continuously extended without being cut between said one end 171 and the other end 173.

In addition, the blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

When at least a portion of the blade 170 is parallel to the longitudinal direction L or the circumferential direction C of the pillar 150, it may be disadvantageous to forming the ascending water flow or the descending water flow resulted from the rotation of the pillar 150. Accordingly, in one embodiment of the present disclosure, the blade 170 may be inclined with respect to the longitudinal direction L of the pillar 150 over an entire length L2.

Figure 4:
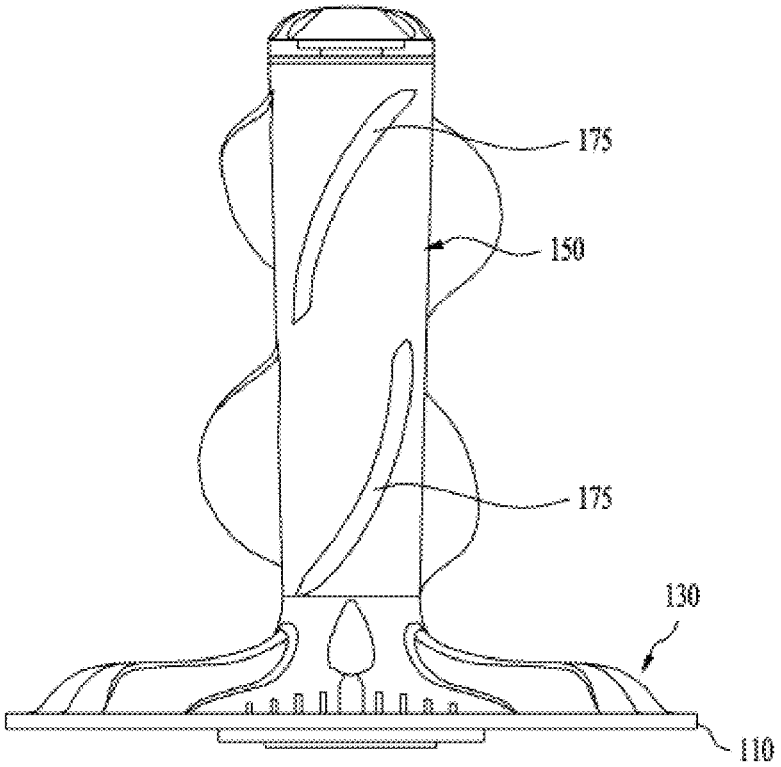
FIG. 4 is a view showing a blade composed of a plurality of divided bodies in a laundry treating apparatus according to another embodiment of the present disclosure.

In one example, another embodiment of the present disclosure is shown in FIG. 4. Referring to FIG. 4, in another embodiment of the present disclosure, the blade 170 may be composed of a plurality of divided bodies 175 separated from each other between said one end 171 and the other end 173.

In another embodiment of the present disclosure, a resistance of water acting on the blade 170 during the rotation of the rotator 100 may be reduced. Accordingly, a load of the driver 50 with respect to the rotation of the rotator 100 may be reduced.

FIG. 4 shows a state in which one blade 170 is composed of two divided bodies 175 according to another embodiment of the present disclosure. However, in FIG. 4, the two divided bodies 175 positioned in a line in a vertical direction do not constitute one blade 170 together. In FIG. 4, a divided body 175 located above corresponds to an upper portion of one blade 170, and a divided body 175 located below corresponds to a lower portion of a blade 170 adjacent to said one blade 170.

In the present disclosure, the blade 170 may be integrally formed or composed of the plurality of divided bodies 175 in consideration of a load of the driver 50, a washing efficiency, and the like that are typically expected in the laundry treating apparatus 1.

Figure 5:
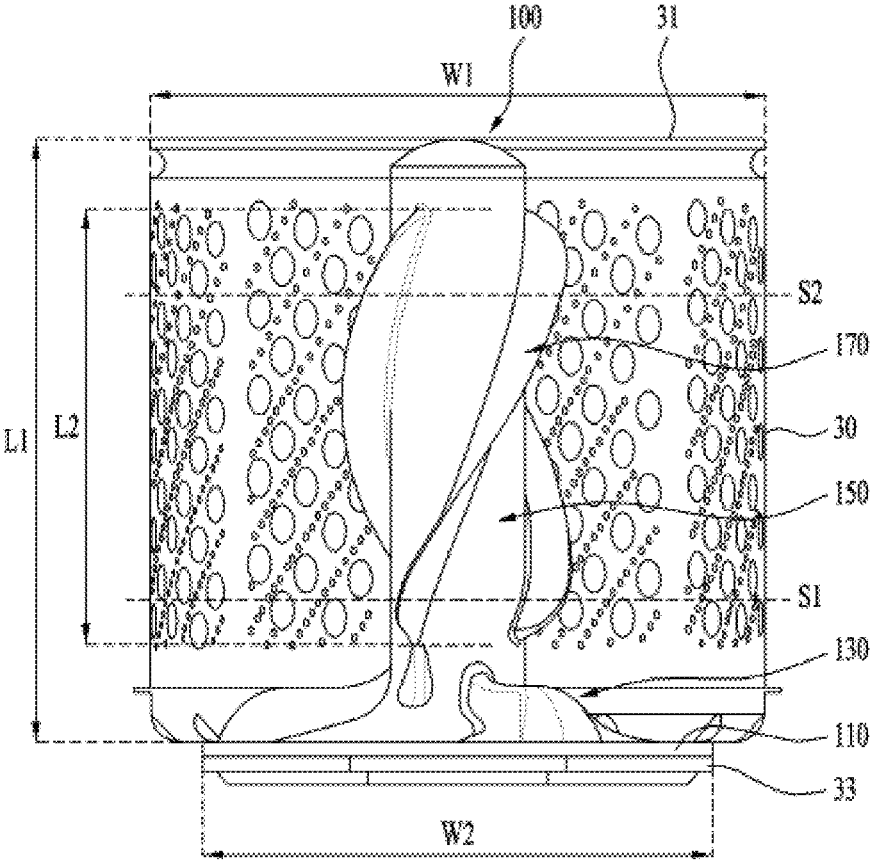
FIG. 5 is a view showing a drum and a rotator in a laundry treating apparatus according to an embodiment of the present disclosure.

In one example, FIG. 5 shows the rotator 100 disposed inside the drum 30 according to an embodiment of the present disclosure.

A length L1 of the pillar 150 may be related to a washing performance and the load of the driver 50. For example, when the length L1 of the pillar 150 is increased, the washing performance may be improved, but an excessive load may be applied to the driver 50. When the length L1 of the pillar 150 is reduced, the load on the driver 50 may be reduced, but the washing performance may also be reduced.

Considering the above relationship, one embodiment of the present disclosure may determine a ratio between the length L1 of the pillar 150 and a diameter W2 of the bottom portion 110. When the length L1 of the pillar 150 is too small, and when an amount of water supplied is large because of a large amount of laundry, because an area in which the water flow is formed by the pillar 150 and the blade 170 is reduced, the washing performance may be deteriorated.

When the length L1 of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

In addition, the bottom portion 110 contributes to the formation of the water flow as a protrusion 130 or the like is formed thereon as will be described below. Therefore, the relationship between lengths of the bottom portion 110 and the pillar 150 determines an effect of the water flow by the bottom portion 110 and an effect of the water flow by the pillar 150.

With respect to various diameters W2 of the bottom portion 110 and lengths L1 of the pillar 150, ascending and descending of the laundry with the water may take place effectively when the length L1 of the pillar 150 is 0.8 times the diameter W2 of the bottom portion 110, and the load of the driver 50 with respect to the rotation of the rotator 100 may be properly maintained when the length L1 of the pillar 150 is equal to or less than 1.2 times the diameter W2 of the bottom portion 110.

The diameter W2 of the bottom portion 110 may be determined variously in consideration of the diameter of the pillar 150, the sizes of the tub 20 and the drum 30 of the laundry treating apparatus 1, a capacity of the laundry allowed in the laundry treating apparatus 1, the amount of water supply resulted therefrom, and the like.

The length L1 of the pillar 150 may be variously determined in consideration of a diameter W1 of the drum 30 as well as a height of the drum 30, a diameter of the pillar 150, an inclination angle A of the blade 170, and the like.

One embodiment of the present disclosure determines an allowable ratio between the length L1 of the pillar 150 and the diameter W2 of the bottom portion 110. Accordingly, the rotator 100 in which the load of the driver 50 is within an allowable range while the formation of the water flow by the pillar 150 is effectively achieved may be implemented.

In one example, in one embodiment of the present disclosure, the diameter W2 of the bottom portion 110 may be equal to or greater than 0.7 times and equal to less than 0.9 times the diameter W1 of the drum 30. However, the present disclosure is not necessarily limited thereto.

Because the bottom portion 110 is positioned on the bottom surface 33 of the drum 30 and rotated, the diameter W2 of the bottom portion 110 with respect to the diameter W1 of the drum 30 needs to be considered. When the diameter W2 of the bottom portion 110 is too small, the effect of the water flow by the rotation of the bottom portion 110 may be too small. When the diameter W2 of the bottom portion 110 is too large, it is easy to cause jamming of the laundry and is disadvantageous in the rotation by the load of the driver 50 and the like.

Considering the above relationship, in one embodiment of the present disclosure, the diameter W2 of the bottom portion 110 is equal to or greater than 0.7 times the diameter W1 of the drum 30, which allows the effect of the water flow by the rotation of the bottom portion 110 with respect to an entirety of the drum 30 to be effective. In addition, the diameter W2 of the bottom portion 110 is equal to or less than 0.9 times the diameter W1 of the drum 30, which prevents the jamming of the laundry and minimizes the load of the rotation.

The diameter W1 of the drum 30 may be variously determined in consideration of the capacity of the laundry allowed in the laundry treating apparatus 1, the amount of water supplied, and a relationship with the tub 20.

In one example, in one embodiment of the present disclosure, the blade 170 may have a height L2 from said one end 171 to the other end 173 in the longitudinal direction L of the pillar 150 equal to or greater than 0.5 times the total height L1 of the pillar 150.

A vertical level L4 of said one end 171 and a vertical level of the other end 173 of the blade 170 may be defined as vertical distances from a top surface of the bottom portion 110 as shown in FIGS. 5 and 6. The height L2 from said one end 171 to the other end 173 of the blade 170 may be defined as the height of the blade 170.

The height L2 of the blade 170 may be determined in consideration of a relationship between an ascending amount and a descending amount of the water flow by the blade 170 and the load of the driver 50.

For example, as the height L2 of the blade 170 becomes smaller, the area in which the blade 170 is formed may be reduced, and the ascending amount and the descending amount of the water flow may be reduced.

In addition, as the height L2 of the blade 170 becomes greater, a water flow forming force may become stronger, but the load of the driver 50 may be increased. In addition, the height L2 of the blade 170 may be related to the inclination angle A of the blade 170, the diameter of the pillar 150, and the like.

In one embodiment of the present disclosure, the height L2 of the blade 170 may be equal to or greater than 0.5 times the length L1 of the pillar 150. Accordingly, in one embodiment of the present disclosure, the blade 170 may form an ascending water flow and a descending water flow effective inside the drum 30 effective when the pillar 150 rotates. When the height L2 of the blade 170 is less than 0.5 times the length L1 of the pillar 150, it may be difficult to effectively form the water flow by the blade 170.

The height L2 of the blade 170 may be variously determined based on the size of the drum 30, the diameter W2 of the bottom portion 110, the height L1 of the pillar 150, the height of the protrusion 130, the position of the cap 165, and the like.

In one example, in one embodiment of the present disclosure, the blade 170 may have a length L3 extending from said one end 171 to the other end 173 along an extension direction equal to or greater than 1.4 times and equal to or less than 1.8 times the height L2 from said one end 171 to the other end 173 with respect to the longitudinal direction L of the pillar 150. However, this means an optimal design value and the present disclosure is not necessarily limited thereto.

The length L3 extending from said one end 171 to the other end 173 along the extension direction of the blade 170 may be defined as an extension length of the blade 170, and the height L2 from said one end 171 to the other end 173 of the blade 170 may be defined as a height of the blade 170.

For example, when the number of turns that the blade 170 is wound on the pillar 150 at the same height L2 of the blade 170 is increased, the extension length L3 of the blade 170 is increased.

When the extension length L3 of the blade 170 with respect to the height L2 of the blade 170 becomes larger, a contact area between the blade 170 and the water may increase and the inclination angle A of the blade 170 may be increased. Thus, an influence of the water flow formation on the water may be increased, but the load of the driver 50 may also be increased.

On the other hand, when the extended length L3 of the blade 170 is excessively reduced, the load of the driver 50 may be reduced, but a water flow forming ability may be excessively reduced, thereby reducing the washing efficiency.

In one embodiment of the present disclosure, the extension length L3 of the blade 170 may be equal to or greater than 1.4 times the height L2 of the blade 170 to secure the inclination angle A of the blade 170 for effectively forming the water flow and to effectively secure the contact area between the blade 170 and the water.

In addition, in one embodiment of the present disclosure, the extension length L3 of the blade 170 may be equal to or less than 1.8 times the height L2 of the blade 170, which may be advantageous for formation of a rotational water flow by the blade 170 while the load of the driver 50 does not deviate from an allowable range.

The extended length L3 of the blade 170 may be variously determined depending on the height L2 of the blade 170, the diameter of the pillar 150, the inclination angle A of the blade 170, the load amount of the driver 50, a water flow formation level, and the like.

In one example, one embodiment of the present disclosure may include the water supply 60 and the controller 70 as described above. The water supply 60 may be constructed to supply the water into the tub 20, and the controller 70 may control the water supply 60 in the washing process to adjust the amount of water supplied.

The controller 70 may control the water supply 60 such that the amount of water supplied preset based on an amount of laundry selected by the user through the manipulation unit in the washing process is supplied into the tub 20.

For example, when the user selects a minimum amount as the amount of laundry or when the amount of laundry is identified to be the minimum amount through a sensor or the like, a minimum amount of water supplied corresponding to the minimum amount of laundry may be preset in the controller 70, and the controller 70 may control the water supply 60 such that the minimum amount of water supplied is supplied into the tub 20.

In addition, when the amount of laundry is identified as a maximum amount by the user, the sensor, or the like, a maximum amount of water supplied corresponding to the maximum amount of laundry may be preset in the controller 70, and the controller 70 may control the water supply 60 such that the maximum amount of water supplied is supplied into the tub 20.

There may be various minimum criteria for the amount of laundry. For example, in a standard washing ability test in the United States, an amount of laundry of 3 kg or an amount of laundry of 8 lb is presented as a small amount criteria. In one embodiment of the present disclosure, the minimum amount of water supplied may be an amount of water supplied preset for the laundry amount corresponding to 8 lb. In addition, there may be various maximum criterion for the amount of laundry.

In one embodiment of the present disclosure, a water surface S1 corresponding to the minimum amount of water supplied and a water surface S2 corresponding to the maximum amount of water supplied are shown in FIG. 5. Referring to FIG. 5, in one embodiment of the present disclosure, the controller 70 may control the water supply 60 such that the amount of water supplied is equal to or greater than the preset minimum amount of water supplied in the washing process, and the blade 170 may be constructed such that the vertical level L4 of said one end 171 with respect to the bottom portion 110 is equal to or lower than a vertical level of the water surface S1 corresponding to the minimum amount of water supplied.

Figure 7:
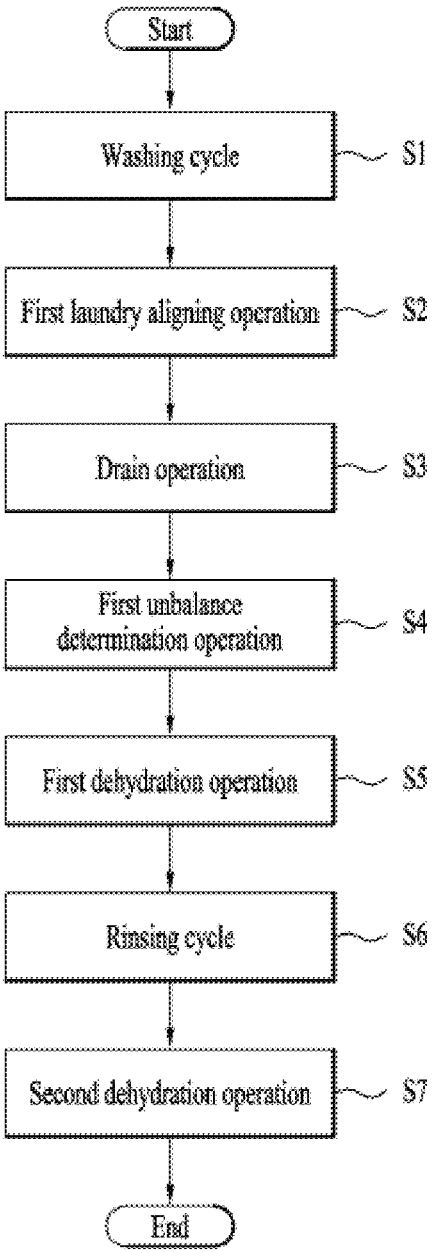
FIGS. 7 to 9 are views showing a method for controlling a laundry treating apparatus according to an embodiment.

When the blade 170 is not submerged in the water, even when the rotator 100 rotates, the ascending water flow and the descending water flow by the blade 170 are not formed, which is disadvantageous. Therefore, in one embodiment of the present disclosure, in the washing process, at least the minimum amount of water supplied may be supplied into the tub 20. In addition, as shown in FIG. 7, said one end 171 of the blade 170 may be positioned at a vertical level equal to or lower than the vertical level of the water surface S1 corresponding to the preset minimum amount of water supplied such that the blade 171 may be always positioned at a vertical level equal to or lower than a vertical level of a water surface and submerged in the water despite a change in the amount of water supplied.

The minimum amount of water supplied may be the amount of water supplied for the amount of laundry of 8 lb, which is a criteria of a small load test in the authorized laundry test in the United States, as described above.

In one example, in one embodiment of the present disclosure, the height L4 of the blade 170 may be equal to or less than 0.25 times the diameter W1 of the drum 30. This means an optimal design value and the present disclosure is not necessarily limited thereto.

One embodiment of the present disclosure allows said one end 171 of the blade 170 to be always submerged in the water in the washing process or the rinsing process, so that the water flow formation effect by the rotation of the rotator 100 may occur effectively. To this end, the height L4 of the blade 170 may be designed to be 0.25 times the diameter W1 of the drum 30.

The vertical level L4 of said one end 171 of the blade 170 may be specifically determined based on the minimum amount of water supplied and the diameter W1 of the drum 30. For example, the larger the minimum amount of water supplied, the higher the vertical level L4 of said one end 171 of the blade 170 may be determined. In addition, the larger the diameter W1 of the drum, the lower the vertical level L4 of said one end 171 of the blade 170.

In one embodiment of the present disclosure, the minimum amount of water supplied may be the amount of water supplied for the amount of laundry of 8 lb as described above. Considering the diameter W1 of the drum 30 that is usually determined therefor, the height L4 of the blade 170 may be equal to or less than 0.25 times the diameter W1 of the drum 30, and the vertical level L4 may be lower than the vertical level of the water surface S1.

When the height L4 of said one end 171 of the blade 170 exceeds 0.25 times the diameter W1 of the drum 30, the diameter W1 of the drum 30 must be smaller than necessary in order for the vertical level L4 of said one end 171 of the blade 170 to be lower than the vertical level of the water surface S1 of the minimum amount of water supplied. In this case, an allowable amount of laundry in the laundry treating apparatus 1 may be excessively reduced, which may be disadvantageous.

When the pillar 150 protrudes upward from the bottom portion 110 as shown in FIG. 5, the vertical level L4 of said one end 171 of the blade 170 may correspond to a distance from the bottom portion 110 in a vertical upward direction.

In one embodiment of the present disclosure, as the height L4 of said one end 171 of the blade 170 is equal to or less than 0.25 times the diameter W1 of the drum 30, even at the minimum amount of water supplied, said one end 171 of the blade 170 is able to be in contact with the water and at the same time, the diameter W1 of the drum 30 is able to be sufficiently secured, which may be advantageous for the washing performance.

In one example, in an embodiment of the present disclosure, as for the blade 170, said one end 171 may be located below a water surface of the water stored in the tub 20 and the other end 173 may be located above the water surface in the washing process.

In FIG. 5, the vertical level of the water surface S1 at the minimum amount of water supplied and the vertical level of the water surface S2 at the maximum amount of water supplied, according to an embodiment of the present disclosure are indicated. FIG. 5 shows that said one end 171 of the blade 170 is located at a vertical level closer to the bottom portion 110 than the vertical level of the water surface S1 based on the minimum amount of water supplied, and the other end 173 of the blade 170 is located at a vertical level further from the bottom portion 110 than the vertical level of the water surface S2 based on the maximum amount of water supplied.

In one embodiment of the present disclosure, the other end 173 of the blade 170 is disposed to be spaced apart from the water surface of the water stored in the tub 20 toward the open surface 31 at all times, so that the water flow by the blade 170 may always be formed up to an upper portion of the water even when the amount of water stored in the tub 20 is changed in the washing process.

The position of the other end 173 of the blade 170 may be determined in consideration of various factors such as the diameter W1 of the drum 30, the maximum amount of water supplied, the length L1 of the pillar 150, and the like.

In one example, in the laundry treating apparatus 1 according to one embodiment of the present disclosure, the controller 70 may control the water supply 60 such that the amount of water supplied is equal to or less than the preset maximum amount of water supplied in the washing process. In addition, the blade 170 may be constructed such that the vertical level of the other end 173 with respect to the bottom portion 110 may be equal to or higher than the vertical level of the water surface S2 corresponding to the maximum amount of water supplied.

The amount of water supplied to the tub 20 may vary based on the amount of laundry or the result of manipulation of the manipulation unit by the user. One embodiment of the present disclosure allows the other end 173 of the blade 170 to be located at the vertical level equal to or higher than the vertical level of the water surface S2 even for the maximum amount of water supplied that may be provided to the tub 20 in the washing process, so that the water flow by the blade 170 may be formed up to the upper portion of the water stored in the tub 20 even when the amount of water supplied is changed.

Figure 6A:
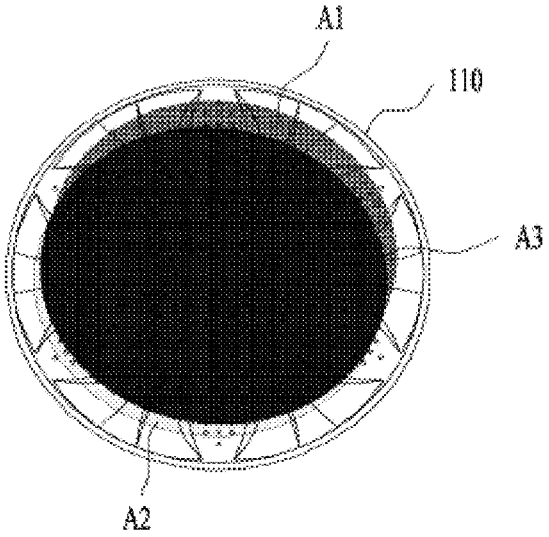
FIGS. 6A and 6B are plan views of an interior of a drum of a conventional laundry treating apparatus, and a plan view of an interior of a drum of a laundry treating apparatus according to an embodiment.
Figure 6B:
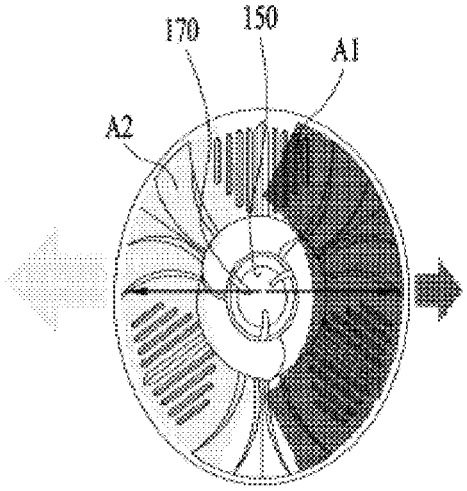

FIGS. 6A and 6B are plan views of an interior of a drum of a conventional laundry treating apparatus, and a plan view of an interior of a drum of a laundry treating apparatus according to an embodiment.

Specifically, FIG. 6A is a plan view of an interior of a drum of a conventional laundry treating apparatus, and FIG. 6B is a plan view of an interior of a drum of a laundry treating apparatus according to an embodiment.

Referring to FIGS. 6A and 6B, the conventional laundry treating apparatus is constructed such that a height of unevenness of the rotator located on the bottom of the drum is not great, and there is no space where a cloth (an object to be washed) is not able to be located. Therefore, there is a high possibility that the cloth is positioned in the form of a disk, and thus, dehydration proceeds without a large vibration or noise.

On the other hand, in the case of the laundry treating apparatus according to an embodiment of the present disclosure, the rotator 100 is disposed in the drum 30 and the rotator 100 includes the pillar 150 having the blade 170 formed thereon.

In the case of the laundry treating apparatus according to an embodiment of the present disclosure, the cloth is not able to be located in a portion where the pillar 150 is disposed. Accordingly, the cloth may be positioned on the bottom portion 110 in a form of a ring or a donut.

In such form, when dehydration proceeds, eccentricity of the cloth may occur during the washing process by a heavy or bulky cloth or a cloth with a high moisture content. Such eccentricity (unbalance) may deteriorate a dehydration performance. In addition, large noise and vibration may be generated along with the performance deterioration, and unnecessary consumption of power may be caused.

Figure 8:
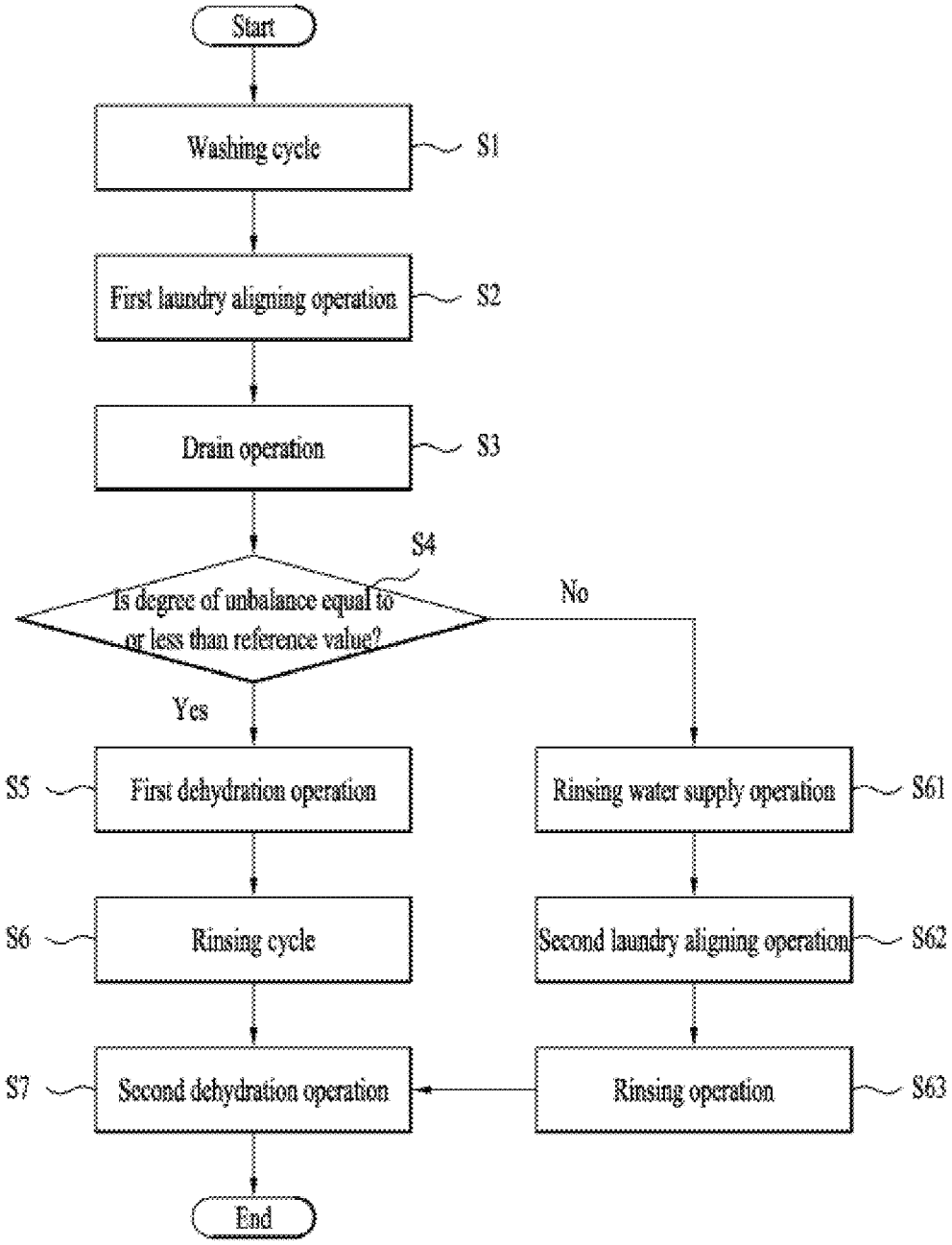
Figure 9:
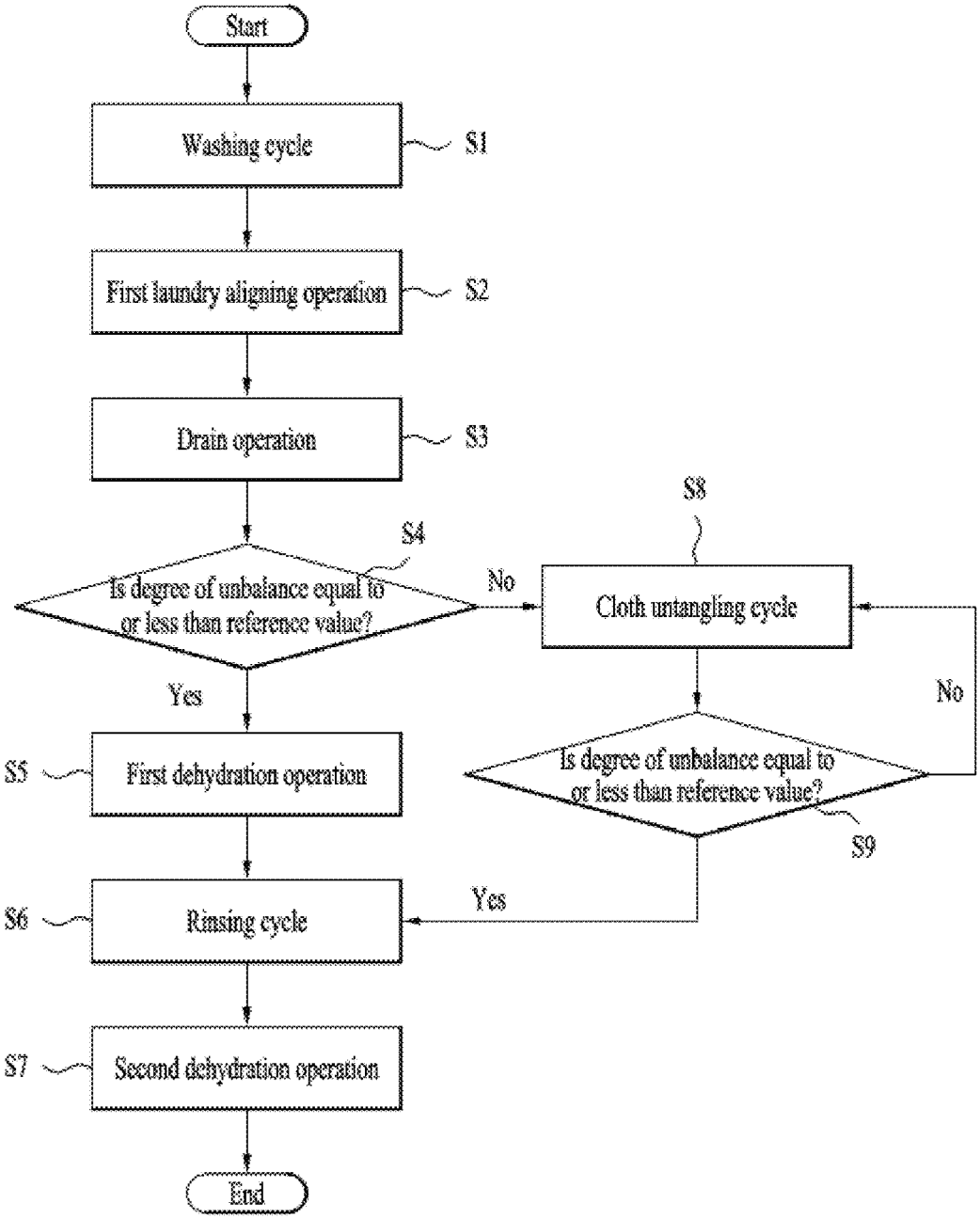

FIGS. 7 to 9 are views showing a method for controlling a laundry treating apparatus according to an embodiment.

FIG. 7 is a view showing a method for controlling a laundry treating apparatus according to an embodiment.

The method for controlling the laundry treating apparatus according to an embodiment of the present disclosure may include a washing cycle S1 and a first laundry aligning operation S2.

The washing cycle S1 is a cycle of removing foreign substances, dust, or stains from the object to be washed (the cloth). The washing cycle S1 may include a washing water supply operation S11 in which water is supplied for washing the cloth and a washing rotation operation S12 in which the rotator 100 and the drum 30 are rotated for washing the cloth.

After the washing rotation operation S12 is completed, a drain operation S3 of discharging the wash water accommodated in the tub 20 to the outside of the cabinet may be performed after the first laundry aligning operation S2 is completed. The reason is that when the laundry is concentrated toward the pillar 150 through the first laundry aligning operation S2, a radius in which the laundry is located is narrowed, so that the drain operation S3 may be smoothly performed, and unbalance resulted from eccentricity may be reduced.

Hereinafter, the first laundry aligning operation S2 will be described in detail.

When the washing cycle S1 is terminated, the first laundry aligning operation S2 may be performed.

The first laundry aligning operation S2 may be an operation in which the rotator 100 is rotated to form the ascending water flow.

More specifically, the rotation of the rotator 100 may include a first rotation forming an ascending water flow and a second rotation forming a descending water flow. As described above, when the blade 170 of the rotator 100 extends inclined in one direction from the bottom surface toward the open surface, the rotator 100 forms the ascending water flow when being rotating in the other direction. Conversely, when the blade 170 of the rotator 100 extends inclined in the other direction from the bottom surface toward the open surface side, the rotator 100 forms the ascending water flow when being rotated in one direction.

This case may be viewed as the first rotation forming the ascending water flow. Because the second rotation is the opposite of the first rotation, a description thereof will be omitted.

The first rotation and the second rotation do not only include a case in which a rotation angle thereof is 360 degrees. For example, the rotation angle of the rotator 100 may be variously changed, for example, the first rotation may be performed by 120 degrees and the second rotation may be performed by 60 degrees.

The first laundry aligning operation S2 may be an operation in which the rotator 100 is controlled such that the first rotation and the second rotation are alternately repeated.

The reason why the second rotation is performed in the first laundry aligning operation S2 even though the first rotation forms the ascending water flow is as follows. When the rotator 100 continuously performs the first rotation, only the ascending water flow is formed in the drum 30 to continuously move the laundry accommodated in the drum 30 toward the pillar 150 of the rotator 100, and move relatively light laundry of the laundry accommodated in the drum toward the open surface 31. Accordingly, the laundry accommodated in the drum 30 may be tangled.

Therefore, the first rotation and the second rotation may be alternately performed to prevent the tangling of the laundry.

A rotation angle of the first rotation may be greater than a rotation angle of the second rotation. More specifically, the rotation of the bottom portion 110 or the rotator 100 may be performed more in a direction forming the ascending water flow than in a direction forming the descending water flow.

Specifically, a rotation angle of the bottom portion 110 or the rotator 100 based on the first rotation may be equal to or greater than twice the rotation angle of the bottom portion 110 or the rotator 100 based on the second rotation. When the bottom portion 110 and the rotator 100 are integrally rotated, the rotation angle of the bottom portion 110 and the rotator 100 in the first rotation may be equal to or greater than twice the rotation angle of the bottom portion 110 and the rotator 100 in the second rotation.

Types of laundry that is the object to be washed may be various. That is, light laundry without a large moisture content and laundry that has a large moisture content or is large or heavy may be accommodated in the drum 30 together.

Therefore, when the first rotation that forms the ascending water flow continues, the light laundry and the heavy laundry accommodated in the drum 30 are moved only in one direction, so that there is a high possibility that the laundry is tangled. As the second rotation is properly performed, the light laundry and the heavy laundry may be easily separated from each other.

As the first laundry aligning operation S2 is performed, the laundry accommodated in the drum 30 may be moved toward the pillar 150. A degree of unbalance resulted from eccentricity may be determined depending on a mass and an angular velocity of the laundry. As described above, the type of laundry may be determined in various ways, so that the mass of laundry among factors that determine the degree of unbalance may vary depending on a user, a situation, and use. However, as the position of the laundry accommodated in the drum 30 is closer to a center of rotation of the drum 30, it is possible to solve the unbalance caused by the eccentricity.

That is, when the first laundry aligning operation S2 is performed, relatively light laundry of the laundry accommodated in the drum 30 ascends upward. In other words, relatively heavy laundry of the laundry accommodated in the drum may be located more adjacent to the bottom portion 110 of the rotator 100 and the bottom surface 33 of the drum 30 than to the open surface 31 of the drum 30. The relatively light laundry of the laundry accommodated in the drum may be located more adjacent to the open surface 31 of the drum 30 than to the bottom surface 33 of the drum 30 and the bottom portion 110 of the rotator 100.

In addition, according to the present embodiment, when the first laundry aligning operation S2 is performed, the laundry accommodated in the drum 30 may be moved toward the rotator 100. As the spirally formed blade 170 rotates, the ascending water flow is formed, and accordingly, the water flow is formed toward the rotator 100. Therefore, the laundry accommodated in the drum may be moved toward the rotator 100.

As a result, as the laundry is concentrated inwardly in the radial direction of the drum 30, the eccentricity decreases, so that the degree of unbalance may be reduced.

The first laundry aligning operation S2 is an operation in which the rotator 100 is controlled such that the first rotation and the second rotation are alternately performed. The first laundry aligning operation (S2) may be performed multiple times. That is, after the first rotation is performed, the second rotation is performed. Then, the first rotation of the rotator 100 may be performed again rather than the first laundry aligning operation (S2) is terminated.

Because the first laundry aligning operation S2 is provided, it is possible to prevent the tangling of the laundry without additional water supply.

When the first laundry aligning operation S2 is terminated, a first unbalance determination operation S4 of determining the degree of unbalance of the laundry accommodated in the drum 30 may be performed.

There is no restriction on a scheme of determining the degree of unbalance. For example, a method of measuring the degree of unbalance by intermittently rotating the drum 30 to sense whether the drum vibrates may be used, and a method of measuring the degree of unbalance by measuring a following RPM when rotating the drum at a target RPM may be used.

In addition, it is possible to determine the degree of unbalance in the drum in various schemes other than the above-described scheme.

When the degree of unbalance in the drum is equal to or less than a preset standard, a first dehydration operation S5 may be performed. The first dehydration operation S5 is an operation of removing the moisture contained in the cloth (the object to be washed) accommodated in the drum. The first dehydration operation S5 may be referred to as a washing dehydration operation. In the first dehydration operation S5, the drum may be rotated at a lower RPM than in a second dehydration operation S7 to be described later. In addition, the drum may be rotated for a shorter time than in the second dehydration operation S7.

This is because the first dehydration operation S5 does not need to last longer than the second dehydration operation S7 as a rinsing cycle S6 is performed after the first dehydration operation S5 is performed.

When the first dehydration operation S5 is terminated, the rinsing cycle S6 may be performed. When a rinsing water supply operation S61 in which wash water for rinsing is input, and a rinsing rotation operation of removing the foreign substances and the detergent remaining in the laundry of the rinsing cycle S6 are terminated, a rinsing drain operation in which the water in the tub 20 is discharged to the outside of the cabinet may be performed.

When the rinsing cycle S6 is terminated, the second dehydration operation S7 may be performed. The second dehydration operation S7 may be an operation of removing the moisture from the laundry such that drying may be performed easily because the moisture content of the cloth (the object to be washed, the laundry) may be increased through the rinsing cycle S6.

The second dehydration operation S7 may last longer than the first dehydration operation S5. In addition, in the second dehydration operation S7, the drum 30 may be rotated at a higher RPM than in the first dehydration operation S5.

When the second dehydration operation S7 is completed, the drying of the laundry may be performed. When the laundry treating apparatus is constructed such that the drying and the washing may be performed together, a drying operation may be performed when the second dehydration operation S7 is completed. In addition, when the laundry treating apparatus according to the present embodiment is constructed such that the drying is not performed, the operation of the laundry treating apparatus may be terminated in a state in which the user is able to withdraw the laundry.

FIG. 8 is a view specifically illustrating a method for controlling a laundry treating apparatus according to an embodiment.

In FIGS. 8 and 9, portions that are different from those described in FIG. 7 above or are specific will be described. Accordingly, descriptions of the same portions as those in FIG. 7 may be omitted.

Referring to FIG. 8, when the degree of unbalance in the drum 30 is equal to or less than the preset standard after the first unbalance determination operation S4 is performed, the first dehydration operation S5 and the rinsing cycle S6 may be performed.

On the other hand, when the degree of unbalance in the drum is equal to or greater than the preset standard, the first dehydration operation S5 may not be performed. The first dehydration operation S5 is performed to remove the foreign substances and the detergent that were not removed in the washing cycle S1. In the first dehydration operation S5, the drum may be rotated at an rpm higher than that of the drum in the washing or the rinsing. That is, the drum may be rotated at an RPM enough to attach the laundry in the drum 30 to an inner wall of the drum 30.

Therefore, when the degree of unbalance in the drum in the first dehydration operation S5 is equal to or greater than the preset standard, even when the drum is rotated at a high RPM, the laundry may be tangled and it may be difficult for the laundry to attach to the inner wall of the drum. Therefore, even when the drum is rotated at the high RPM in the first dehydration operation S5, it may be difficult to effectively remove the moisture contained in the laundry.

When the degree of unbalance in the drum 30 in the first unbalance determination operation S4 is equal to or greater than the preset standard, the rinsing water supply operation S61 in which the wash water for the rinsing cycle S6 is introduced into the tub 20 may be performed.

After the rinsing water supply operation S61 is performed, a second laundry aligning operation S62 may be performed. The second laundry aligning operation S62 may be performed in the same manner as the first laundry aligning operation S2. When the second laundry aligning operation S62 is performed, like in the first laundry aligning operation S2, the laundry in the drum may be moved toward the rotator 100, and the relatively light laundry of the laundry accommodated in the drum 30 may be located more adjacent to the open surface 31 than to the bottom surface 33 of the drum 30 than the relatively heavy laundry.

In one example, the second laundry aligning operation S62 may also be performed multiple times. In this connection, the number of times the second laundry aligning operation S62 is performed may be determined based on the degree of unbalance determined in the first unbalance determination operation S4. The number of times the second laundry aligning operation S62 is performed based on the preset degree of unbalance may be input in advance.

That is, because the first laundry aligning operation S2 is performed immediately before the wash water is drained when the washing cycle S1 is terminated, the first laundry aligning operation S2 may be performed a preset number of times or a user set number of times, or once. On the other hand, in the second laundry aligning operation S62, the number of times the second laundry aligning operation S62 is performed may be determined based on the degree of unbalance determined in the first unbalance determination operation (S4), so that a series of processes may be efficiently performed.

After the second laundry aligning operation S62 is performed, a rinsing operation S63 for rinsing the laundry may be performed. The rinsing operation S63 may include a rinsing rotation operation in which the drum and the rotator are rotated for the rinsing, and a rinsing drain operation in which wash the water is discharged to the outside of the cabinet after the rinsing is terminated.

In other words, when the degree of unbalance in the drum 30 in the first unbalance determination operation S4 is equal to or greater than the preset standard, the first dehydration operation S5 is not performed, but the second laundry aligning operation S62 is performed using the wash water input for rinsing the laundry.

Therefore, because separate water supply is not performed to solve the unbalance of the laundry, a washing time may be saved, and power consumption may be reduced as the washing time is reduced, which is advantageous in terms of energy efficiency.

After the rinsing operation S63 is performed, the second dehydration operation S7 may be performed.

FIG. 9 is a view showing a method for controlling a laundry treating apparatus according to another embodiment.

When the degree of unbalance in the drum 30 is equal to or greater than the preset standard after the first unbalance determination operation S4 is performed, before the rinsing cycle S6 is started, a cloth untangling cycle S8 may be performed.

The cloth untangling cycle S8 may be performed in a different manner from the first laundry aligning operation S2 and the second laundry aligning operation S62. The first laundry aligning operation S2 and the second laundry aligning operation S62 do not require a separate water supply to prevent the tangling of the laundry.

Specifically, the first laundry aligning operation S2 may be performed before the washing drain operation S3 after the washing is completed, and the second laundry aligning operation S62 may be performed after the rinsing water supply operation S61 is performed before the rinsing cycle starts.

In contrast, in the cloth untangling cycle S8, the separate water supply may be performed to solve the tangling of the laundry. The cloth untangling cycle S8 is a cycle of dispersing the laundry. Specifically, the cloth untangling cycle S8 may be a process in which rotation in one direction and rotation in the other direction of the drum are repeated.

Because the first laundry aligning operation S2 and the second laundry aligning operation S62 are operations performed together of the rotator 100 (specifically, the pillar 150), the first laundry aligning operation S2 and the second laundry aligning operation S62 are not the same as the cloth untangling cycle S8.

In the method for controlling the laundry treating apparatus according to another embodiment, the cloth untangling cycle S8 may be performed. That is, the first laundry aligning operation S2 and the cloth untangling cycle may be performed as a series of processes.

It is most preferable in terms of time and energy efficiency that the second laundry aligning operation S62 is performed based on the degree of unbalance, but the existing control methods may be mixed and used.

After the cloth untangling cycle S8 is performed, a second unbalance determination operation S9 of re-determining the degree of unbalance may be performed. When the degree of unbalance in the drum in the second unbalance determination operation S9 is too large to activate the rinsing cycle S6, the cloth untangling cycle may be performed again.

Specifically, when the cloth untangling cycle S8 is terminated, the wash water input for the cloth untangling cycle S8 may be discharged to the outside of the cabinet 10, and the second unbalance determination operation S9 may be performed.

When the degree of unbalance in the drum 30 in the second unbalance determination operation S9 is equal to or greater than the preset standard, the cloth untangling cycle may be performed again. In this case, re-water supply may be performed.

When the degree of unbalance in the drum 30 in the second unbalance determination operation S9 is equal to or less than the preset standard, the rinsing cycle S6 may be performed.

That is, the first laundry aligning operation S2 and the cloth untangling cycle S8 may be performed as a series of processes, thereby broadening a range of consumer choice.

When only the first laundry aligning operation S2 is performed or when the first laundry aligning operation S2 and the second laundry aligning operation S62 are performed, it is possible to economically use the laundry treating apparatus by reducing an amount of water used. In addition, a user's convenience may be increased by reducing the washing time.

Although various embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of rights of the present disclosure should not be limited to the described embodiment and should be defined by the claims described later as well as the claims and equivalents.

What is claimed is:

1. A laundry treating apparatus comprising:

a cabinet;

a tub configured to receive water;

a drum rotatably disposed in the tub, the drum having an open surface configured to receive laundry therethrough and a bottom surface located at an opposite side of the open surface;

a water supply configured to supply water to the tub;

a drain configured to drain water in the tub to an outside of the cabinet;

a rotator rotatably disposed inside the drum; and a controller configured to control rotation of the rotator, wherein the rotator comprises:

a bottom portion disposed at the bottom surface of the drum, a pillar that protrudes from the bottom portion toward the open surface of the drum, and a flow-forming part comprising a plurality of blades that are spaced apart from one another along a circumferential direction of the pillar, each of the plurality of blades having a helical shape and extending in a direction from the bottom portion toward the open surface of the drum along a longitudinal direction of the pillar, and wherein the controller is configured to:

control the rotator to perform a first rotation operation for generating an ascending water flow in the drum, control the rotator to perform a second rotation operation for generating a descending water flow in the drum, and control the rotator to alternately repeat the first rotation operation and the second rotation operation.

2. The laundry treating apparatus of claim 1, wherein a rotation angle of the bottom portion in the first rotation operation is greater than a rotation angle of the bottom portion in the second rotation operation.

3. The laundry treating apparatus of claim 2, wherein the rotation angle of the bottom portion in the first rotation operation is greater than or equal to twice of the rotation angle of the bottom portion in the second rotation operation.

4. The laundry treating apparatus of claim 1, wherein the controller is configured to perform a dehydration operation of the laundry after alternately repeating the first rotation operation and the second rotation operation.

5. The laundry treating apparatus of claim 1, wherein the controller is configured to:

determine a degree of unbalance of the laundry before performing a dehydration operation of the laundry; and perform the dehydration operation based on determining that the degree of unbalance of the laundry is less than or equal to a preset standard.

6. The laundry treating apparatus of claim 5, wherein the controller is configured to:

supply water to the tub based on determining that the degree of unbalance of the laundry is greater than the preset standard;

after supplying the water to the tub, perform a cloth untangling cycle for dispersing the laundry in the drum; and after performing the cloth untangling cycle, determine the degree of unbalance of the laundry again.

7. The laundry treating apparatus of claim 6, wherein the cloth untangling cycle comprises repeating at least one of the first rotation operation or the second rotation operation after supplying the water to the tub.

8. The laundry treating apparatus of claim 5, wherein the controller is configured to:

supply water to the tub for a rinsing cycle based on determining that the degree of unbalance of the laundry is greater than the preset standard;

alternately repeat the first rotation operation and the second rotation operation after supplying the water to the tub for the rinsing cycle; and perform the rinsing cycle after alternately repeating the first rotation operation and the second rotation operation.

9. A method for controlling a laundry treating apparatus including a cabinet, a tub configured to receive water, a drum that is rotatably disposed in the tub and that has an open surface configured to receive laundry therethrough and a bottom surface located at an opposite side of the open surface, a water supply configured to supply water to the tub, a drain configured to drain water in the tub to an outside of the cabinet, a rotator rotatably disposed inside the drum, and a controller configured to control rotation of the rotator, the rotator including a bottom portion positioned at the bottom surface of the drum, a pillar that protrudes from the bottom portion toward the open surface of the drum, and a flow-forming part including a plurality of blades that are spaced apart from one another along a circumferential direction of the pillar, each of the plurality of blades having a helical shape and extending in a direction from the bottom portion toward the open surface of the drum along a longitudinal direction of the pillar, the method comprising:

performing a washing cycle for washing the laundry in the drum; and after termination of the washing cycle, performing a first laundry aligning operation including:

controlling the rotator to perform a first rotation operation for generating an ascending water flow in the drum, controlling the rotator to perform a second rotation operation for generating a descending water flow in the drum, and controlling the rotator to alternately repeat the first rotation operation and the second rotation operation.

10. The method of claim 9, further comprising:

after termination of the first laundry aligning operation, performing a first dehydration operation including discharging wash water in the tub to the outside of the cabinet;

after the first dehydration operation, performing a rinsing cycle for removing foreign substances or detergent in the laundry; and after the rinsing cycle, performing a second dehydration operation including discharging the wash water in the tub to the outside of the cabinet.

11. The method of claim 9, wherein a rotation angle of the bottom portion in the first rotation operation is greater than a rotation angle of the bottom portion in the second rotation operation.

12. The method of claim 11, wherein the rotation angle of the bottom portion in the first rotation operation is greater than or equal to twice of the rotation angle of the bottom portion in the second rotation operation.

13. The method of claim 9, further comprising repeating the first laundry aligning operation multiple times.

14. The method of claim 10, further comprising:

determining whether a degree of unbalance of the laundry is less than or equal to a preset standard before performing the first dehydration operation.

15. The method of claim 14, further comprising:

based on determining that the degree of unbalance of the laundry is less than or equal to the preset standard, performing the first dehydration operation and the rinsing cycle.

16. The method of claim 14, further comprising:

based on the determining that the degree of unbalance of the laundry is greater than the preset standard, supplying water for the rinsing cycle to the tub before starting the rinsing cycle; and after supplying the water for the rinsing cycle to the tub, performing a second laundry aligning operation that includes alternately performing the first rotation operation and the second rotation operation.

17. The method of claim 16, further comprising repeating the second laundry aligning operation multiple times.

18. The method of claim 15, further comprising:

based on determining that the degree of unbalance of the laundry is greater than the preset standard, performing a cloth untangling cycle for dispersing the laundry in the drum, the cloth untangling cycle comprising:

supplying water to the tub for the rinsing cycle, and after supplying the water to the tub for the rinsing cycle, repeating at least one of the first rotation operation or the second rotation operation; and after performing the cloth untangling cycle, determining the degree of unbalance of the laundry again.

19. The method of claim 10, wherein the first dehydration operation comprises rotating the drum at a first rotation speed, and wherein the second dehydration operation comprises rotating the drum at a second rotation speed greater than the first rotation speed.

20. The method of claim 10, wherein the first dehydration operation comprises rotating the drum for a first duration, and wherein the second dehydration operation comprises rotating the drum for a second duration greater than the first duration.

* * * * *